US008736169B2

(12) United States Patent
Park et al.

(10) Patent No.: US 8,736,169 B2
(45) Date of Patent: May 27, 2014

(54) ELECTRON BEAM GENERATING APPARATUS

(75) Inventors: Yong Woon Park, Jeollanam-do (KR); Sung Ju Park, Gyeongsangbuk-do (KR); In Soo Ko, Gyeongsangbuk-do (KR); Chang Bum Kim, Gyeongsangbuk-do (KR); Ju Ho Hong, Gyeongsangbuk-do (KR); Sung Ik Moon, Gyeongsangbuk-do (KR)

(73) Assignee: Postech Academy-Industry Foundation, Gyeongsangbuk-Do (KR)

( * ) Notice: Subject to any disclaimer, the term of this patent is extended or adjusted under 35 U.S.C. 154(b) by 0 days.

(21) Appl. No.: 13/122,109

(22) PCT Filed: Aug. 10, 2010

(86) PCT No.: PCT/KR2010/005236
§ 371 (c)(1), (2), (4) Date: Mar. 31, 2011

(87) PCT Pub. No.: WO2011/021802
PCT Pub. Date: Feb. 24, 2011

(65) Prior Publication Data

US 2012/0133281 A1 May 31, 2012

(30) Foreign Application Priority Data

Aug. 21, 2009 (KR) ..... 10-2009-0077796

(51) Int. Cl.
*H01J 29/80* (2006.01)

(52) U.S. Cl.
USPC ..... 315/5.41; 315/500; 333/21 R

(58) Field of Classification Search
USPC ..... 315/5.41, 500; 333/21 R
See application file for complete search history.

(56) References Cited

U.S. PATENT DOCUMENTS 4,988,956 A * 1/1991 Ono et al. ..... 331/86
6,448,722 B1 * 9/2002 Yu et al. ..... 315/505

FOREIGN PATENT DOCUMENTS

CN 1108430 9/1995
JP S61-206143 A 9/1986

(Continued)

OTHER PUBLICATIONS

Limborg, et al., RF Design of the LCLS Gun, Feb. 9, 2005, LCLS Technical Note LCLS-TN-05-3 (Stanford, 2005) pp. 1-12.*
Guan et al., "Study of RF-asymmetry in photo-injector", Nuclear Instruments and Methods in Physics Research, A, 574, pp. 17-21 (2007).
Xiao et al., "Dual Feed RF Gun Design for the LCLS", Proceedings of 2005 Particle Accelerator Conference, Knoxville, Tennessee, pp. 3432-3434, 2005.

(Continued)

*Primary Examiner* — Alexander H Taningco
*Assistant Examiner* — David Lotter
(74) *Attorney, Agent, or Firm* — McCarter & English, LLP; David R. Burns

(57) ABSTRACT

An apparatus for generating an electron beam is disclosed to reduce emittance of an electron beam. The apparatus includes: a housing including a rear portion where an electron beam is generated, a front portion having an electron beam discharge hole for discharging the electron beam to the exterior, and a side portion connecting the rear portion and the front portion, the side portion having a first hole and an opposite side portion, facing the first hole, having a second hole in order to reduce asymmetry of an electric field caused by the first hole; and a waveguide installed on the side portion to supply an electromagnetic wave to the interior of the housing through the first hole, wherein the electron beam is generated by laser incident to the interior of the housing and accelerated by the electromagnetic wave supplied to the interior of the housing.

13 Claims, 21 Drawing Sheets

(56) References Cited

FOREIGN PATENT DOCUMENTS

| | | | |
|---|---|---|---|
| JP | 61-273833 | | 12/1986 |
| JP | 63-128523 | | 6/1988 |
| JP | 06-012992 | | 1/1994 |
| JP | H06-176723 | A | 6/1994 |
| JP | 07-050135 | | 2/1995 |
| JP | H07-065707 | A | 3/1995 |
| JP | H10-247598 | A | 9/1998 |
| JP | H11-023482 | A | 1/1999 |
| JP | H11-045676 | A | 2/1999 |
| JP | 2000-012300 | A | 1/2000 |
| JP | 2000-223056 | | 8/2000 |
| KR | 10-0783409 | | 12/2007 |
| KR | 10-0787168 | | 12/2007 |

OTHER PUBLICATIONS

Boyce et al. "Design Considerations for the LCLS RF Gun", Stanford Linear Accelerator Center, LCLS TN 04-4, pp. 1-22 (2004).

Search Report issued by the Korean Intellectual Property Office on Apr. 21, 2011 for corresponding International Filing No. PCT/KR2010/005236.

Notice of Allowance issued by the Korean Intellectual Property Office on May 30, 2011 for corresponding Korean Patent Application No. 10-2009-0077796.

Limborg, C. et al., RF Design of the LCLS Gun, Feb. 9, 2005.

* cited by examiner

ELECTRON BEAM GENERATING APPARATUS

TECHNICAL FIELD

The present invention relates to an apparatus for generating an electron beam by using laser.

BACKGROUND ART

In general, an electron gun refers to a device for making a flow of electrons converged in the form of a thin beam so as to be discharged, like an electron microscope, traveling wave tube, Braun tube, or the like.

The related art electron gun uses electromagnetic waves in order to accelerate an electron beam passing through the interior of a coupler cell. Namely, electromagnetic waves are made incident to the interior of the coupler cell through a coupling hole formed in the coupler cell. However, the symmetry of electric fields in the interior of the coupler cell is lost due to the coupling hole. The loss of the symmetry of the electric fields increases emittance of the electron beam, resulting in a degradation of quality of the electron beam.

DISCLOSURE

Technical Problem

It is, therefore, an object of the present invention to provide an apparatus for generating an electron beam capable of reducing emittance of an electron beam.

Technical subjects of the present invention are not limited to the foregoing technical subjects and any other technical subjects not mentioned will be clearly understood by a skilled person in the art from the following description.

Technical Solution

In order to obtain the above object, there is provided an apparatus for generating an electron beam, including: a housing including a rear portion where an electron beam is generated, a front portion having an electron beam discharge hole for discharging the electron beam to the exterior, and a side portion connecting the rear portion and the front portion, the side portion having a first hole and an opposite side portion, facing the first hole, having a second hole in order to reduce asymmetry of an electric field caused by the first hole; and a waveguide installed on the side portion to supply an electromagnetic wave to the interior of the housing through the first hole, wherein the electron beam is generated by laser incident to the interior of the housing and accelerated by the electromagnetic wave supplied to the interior of the housing.

The laser may be made incident to the interior of the housing through the front portion.

The apparatus may further include: a first pumping port installed on the side portion and discharging air of the interior of the housing through the second hole to make the interior of housing vacuumized.

The second hole may have a shape different from that of the first hole.

The second hole may be formed to have a shape elongated in one direction.

The second hole may have a substantially oval shape or a racetrack-like shape.

The side portion may include first and second side portions, the front portion may be coupled to the first side portion, the first and second side portions may be connected by a connection portion, the second side portion may be coupled to the rear portion, and the first and second holes may be formed on the first housing or the second housing.

The housing may include an incident hole through which laser is made incident to the interior of the housing, and a discharge hole through which the laser reflected in the interior of the housing is discharged.

Laser may be made incident through the electron beam discharge hole, and laser reflected from the rear portion may be discharged through the electron beam discharge hole.

A third hole may be formed in the middle between the first and second holes on the side portion of the housing and a fourth hole may be formed on an opposite side portion facing the third hole, in order to reduce asymmetry of an electric field caused by the first hole.

The third and fourth holes may have a shape elongated in one direction.

The third and fourth holes may have a substantially oval shape or a racetrack-like shape.

The second to fourth holes may have the same shape.

A second pumping port may be installed at a position where the third hole is formed, and a third pumping port may be installed at a position where the fourth hole is formed.

Advantageous Effects

According to exemplary embodiments of the present invention, since asymmetry of an electric field is improved, emittance of an electron beam can be reduced.

In addition, compared with the related art electron beam generation apparatus in which a laser input hole and a laser output hole are separately prepared on a side portion of a housing, in an exemplary embodiment of the present invention, only a single hole is formed on a front portion of a housing to input and output a laser beam and also used as an electron beam discharge hole, thus facilitating the fabrication.

Technical effects of the present invention are not limited to the foregoing technical effects and any other technical effects not mentioned will be clearly understood by a skilled person in the art from the following description.

DESCRIPTION OF DRAWINGS

The above and other objects and features of the present invention will become apparent from the following description of preferred embodiments given in conjunction with the accompanying drawings, in which.

BEST MODE

Figure 1:
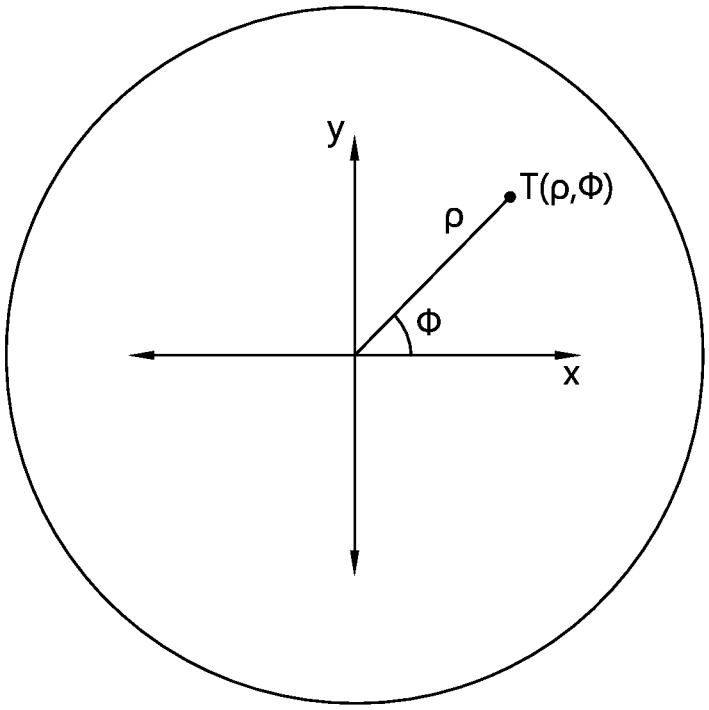
FIG. 1 is a sectional view schematically showing a housing under ideal conditions without a coupling hole.

Hereinafter, exemplary embodiments of the present invention will be described in detail with reference to the accompanying drawings. The embodiments of the present invention, however, may be changed into several other forms, and the scope of the present invention should not be construed as being limited to the following embodiments. The embodiments of the present invention are intended to more comprehensively explain the present invention to those skilled in the art. Accordingly, the shapes of elements or the like shown in figures are exaggerated to emphasize distinct explanation, and elements indicated by like reference numerals in the figures mean like elements.

MODE FOR INVENTION

An apparatus for generating an electron beam having powerful yet small emittance is required. Emittance $\epsilon$ has three components and can be represented by Equation 1 shown below:

$$\epsilon=\sqrt{\epsilon_{th}^2+\epsilon_{sc}^2+\epsilon_{rf}^2} \quad \text{[Equation 1]}$$

Here, $\epsilon_{th}$ is a thermal emittance, $\epsilon_{sc}$ is emittance according to a space charge effect, and $\epsilon_{rf}$ is emittance according to an RF dynamics effect.

The thermal emittance $\epsilon_{th}$ can be reduced by controlling an incident angle of laser with respect to a cathode surface. The overall emittance $\epsilon$ is quite high compared with the thermal emittance. This is because an increase in the emittance according to the space charge effect and the RF dynamics effect cannot be negligible over the thermal emittance. $\epsilon_{sc}$ can be reduced by using a special 3D uniform ellipsoidal laser pulse and a very strong electric field. A main concern of the present invention is how to reduce the third component $\epsilon_{rf}$ in order to reduce the overall emittance.

Figure 2:
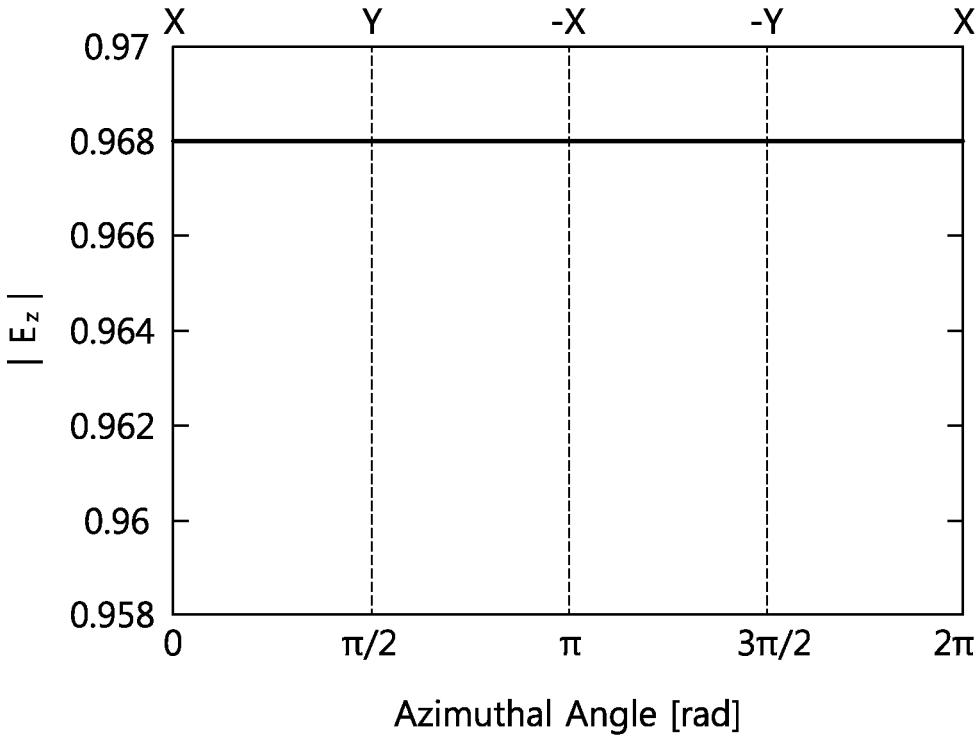
FIG. 2 is a graph showing an electric field of the housing under the ideal conditions without a coupling hole.

FIG. 1 is a sectional view schematically showing a housing under ideal conditions without a coupling hole, and FIG. 2 is a graph showing an electric field of the housing under the ideal conditions without a coupling hole.

In FIG. 1, the direction perpendicular to the plane on which the FIG. 1 is printed is a direction in which an electron beam proceeds, and a circular rim indicates the housing. X axis and y axis indicate orthogonal coordinate axes based on the center of a resonant cavity within the housing. ρ is the distance from the center of the resonant cavity to a certain position T, and Φ is the angle between a straight line formed by connecting the center of the resonant cavity and the coordinates T and the x axis. In FIG. 2, $|E_z|$ is an electric field from the center of the resonant cavity to a certain distance. An electric field generated in the resonant cavity of the electron beam generation apparatus can be represented by Equation 2 shown below:

$$\begin{aligned}
|E_z(\rho,\phi)| &= \sum_{m=0}^{\infty} A_{m10} T M_{m10} \\
&= E_0 \sum_{m=0}^{\infty} A_{m10} J_m\left(\frac{x_{m1}\rho}{R}\right)\cos m\phi \\
&= E_0 \left[ A_{010} J_0\left(\frac{x_{01}\rho}{R}\right) + A_{110} J_1\left(\frac{x_{11}\rho}{R}\right)\cos\phi + A_{210} J_2\left(\frac{x_{21}\rho}{R}\right)\cos 2\phi + \ldots \right] \\
&\approx E_0 A_{010} + E_0 \frac{A_{110} x_{11}}{2R}\rho\cos(\phi) + E_0 \frac{A_{210} x_{21}^2}{8R^2}\rho^2\cos(2\phi) + \ldots (\because \rho < R)
\end{aligned} \quad \text{[Equation 2]}$$

Here, $x_{m1}$ is a first root of $J_m(x)=0$, $E_0$ is a maximum electric field, R is a radius of the resonant cavity, and $A_{m10}$ is an m-th Fourier coefficient. As for $|E_z|$ in an ideal electron beam generation apparatus, as shown in FIG. 2, only a monopole field exists, and it has a fixed value although the angle Φ is changed.

However, the electron beam generation apparatus must necessarily includes a coupling hole formed on the side of the housing in order to supply RF power required for accelerating the electron beam. The coupling hole is able to induce a force in a lateral direction (i.e., x-y planar direction) within the resonant cavity, causing an asymmetrical electric field. The asymmetry of the electric field may increase in a multi-pole field, and the multi-pole field generates a transverse momentum kick increasing emittance with respect to the electron beam generated by the electron beam generation apparatus.

The Panofsky-Wenzel theorem provides the transverse momentum kick $p_\perp$ the electric field of the resonant cavity as expressed by Equation 3 shown below:

$$p_\perp = \left(\frac{e}{\omega_0}\right)\int_0^L (-i)\nabla_\perp E_z dz \quad \text{[Equation 3]}$$

Here, $\omega_0$ is a resonant frequency of the cavity, L is the length of the resonant cavity, and $E_z$ is a longitudinal component of the electric field of the resonant cavity. The Panofsky-Wenzel theorem can be applicable to a constant velocity case. Since the speed of electrons is increased merely slightly within the resonant cavity in spite of the increase in a kinetic energy, in the present exemplary embodiment, the resonant cavity area meets such conditions. The transverse momentum kick in Equation 3 indicates the increment of the overall emittance as described hereinafter.

The asymmetrical form of the resonant cavity causes the multi-pole field. In general, the resonant cavity has a limited quality factor, so there is a power flow in the resonant cavity. Thus, the multi-pole field includes a traveling wave traveling along the y axis. A phase asymmetry of the multi-pole field in the y-axis direction resulting from the traveling wave component should be considered in analyzing the electric field of the resonant cavity. The electric field in the resonant cavity can represented as a superposition of the multi-pole field as shown in Equation 4 below:

$$E_z = E_0 \sin(\omega t - K_y y) \times \sum_{n=0}^{\infty} a_n r^n \cos n\varphi \quad \text{[Equation 4]}$$

Here, $E_0$ is the maximum value of the electric field, $K_y$ is the phase distribution coefficient in the y-axis direction, $a_n$ is the Fourier coefficient of multipole field, $\omega$ is the resonant frequency of the cavity. Emittance growth caused by the multi-pole field can be calculated by using the Fourier coefficient of the Equation 4.

Emittance caused by monopole component can be calculated as below.

$$\varepsilon_{n,rms}^{monopole} = \sqrt{\frac{13}{20}}\,\frac{eE_0}{2m_e c^2}\sigma_y^2 (k\sigma_z)^2 \quad \text{[Equation 5]}$$

Here, k is a wave number of the RF field, $\sigma_y$ is a beam size, and $\sigma_z$ is an rms bunch length. A deviation, i.e., a so-called dipole offset $y_0$ exists between a geometrical center of the cavity and the center of the electric field. The transverse momentum kick according to the dipole field is dependent upon the dipole offset. A dipole offset oscillation according to a phase asymmetry is derived by Guan, as represented by Equation 6 shown below:

$$y_0 \approx -\frac{a_1}{2a_2} + \frac{a_0 K_y}{2a_2} ctg(\omega t) \quad \text{[Equation 6]}$$

Guan proved that $K_y$ in Equation 6 can be negligible because a power flow within a standing wave type RF electron gun is very insignificant. Thus, the amplitude term of Equation 6 is sufficient in calculating an increase in the emittance according to the multipole field. The increase in the emittance according to the dipole field and a quadrupole field is calculated as follows according to the results of research of Palmer.

$$\varepsilon_{n,rms}^{dipole} = \frac{eE_0 L}{2m_e c^2 \pi} \times a_1 \sigma_y \sigma_z \quad \text{[Equation 7]}$$

$$\varepsilon_{n,rms}^{quadrupole} = \frac{eE_0 L}{2m_e c^2 \pi} \times 2a_2 \sigma_y^2 \sigma_z \quad \text{[Equation 8]}$$

Here, L is the length of the resonant cavity in which the asymmetrical RF electric field exists.

Hereinafter, the increase in the emittance according to the dipole field and the quadrupole field will be expressed in a different manner. When a single coupling hole is formed on the resonant cavity, $|E_z|$ can be represented by Equation 9 shown below:

$$|E_z(\phi)| = ME_0 + DE_0 r\cos(\phi) + QE_0 r^2 \cos(2\phi) + \ldots \quad \text{[Equation 9]}$$

In Equation 9, a first term means a monopole field, a second term means a dipole field, and a third term means a quadrupole field. In Equation 9, M, D, and Q, normalized Fourier coefficients, can be expressed by Equation 10 shown below:

$$M = \left|\frac{A_{010}}{A_{010}}\right| = 1,\ D = \left|\frac{A_{110}x_{11}}{A_{010}2R}\right|,\ Q = \left|\frac{A_{210}x_{21}^2}{A_{010}8R^2}\right| \quad \text{[Equation 10]}$$

$$\epsilon_{RF} = \sqrt{\epsilon_M^2 + \epsilon_D^2 + \epsilon_Q^2} \quad \text{[Equation 11]}$$

Equation 11 shows an influence of the monopole field, the dipole field, and quadrupole field on $\epsilon_{RF}$ in the electron beam generation apparatus. $\epsilon_M$ is emittance generated by the monopole field, $\epsilon_D$ is emittance generated by the dipole field, and $\epsilon_Q$ is emittance generated by the quadrupole field. The values of $\epsilon_M$, $\epsilon_D$, $\epsilon_Q$ can be calculated by Equation 12 shown below:

$$\varepsilon_M = M\sqrt{\frac{13}{20}}\,\frac{eE_0}{2m_e c^2}\sigma_y^2 (k\sigma_z)^2 \quad \text{[Equation 12]}$$

$$\varepsilon_D = D\frac{eE_0 L}{2m_e c^2 \pi}\sigma_y \sigma_z$$

$$\varepsilon_Q = Q\frac{eE_0 L}{2m_e c^2 \pi} 2\sigma_y^2 \sigma_z$$

In Equation 12, e is the quantity of electric charge of electrons, $m_e$ is the mass of electrons, c is velocity of light, k is wave number, $\sigma_y$ is the size of an electron beam in the y-axis direction, $\sigma_z$ is the size of the electron beam in the z-axis direction, and L is the length of the resonant cavity. In order to reduce the value of $\epsilon_{RF}$, it is necessary to eliminate the dipole field and the quadrupole field except for the monopole field needed to accelerate the electron beam.

Figure 3:
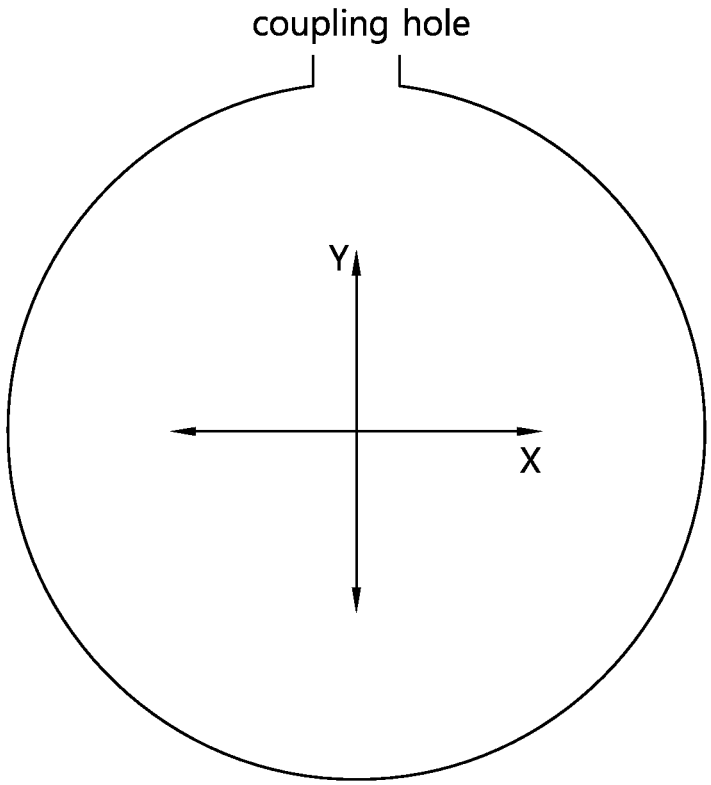
FIG. 3 is a sectional view schematically showing a housing with a single coupling hole.
Figure 4:
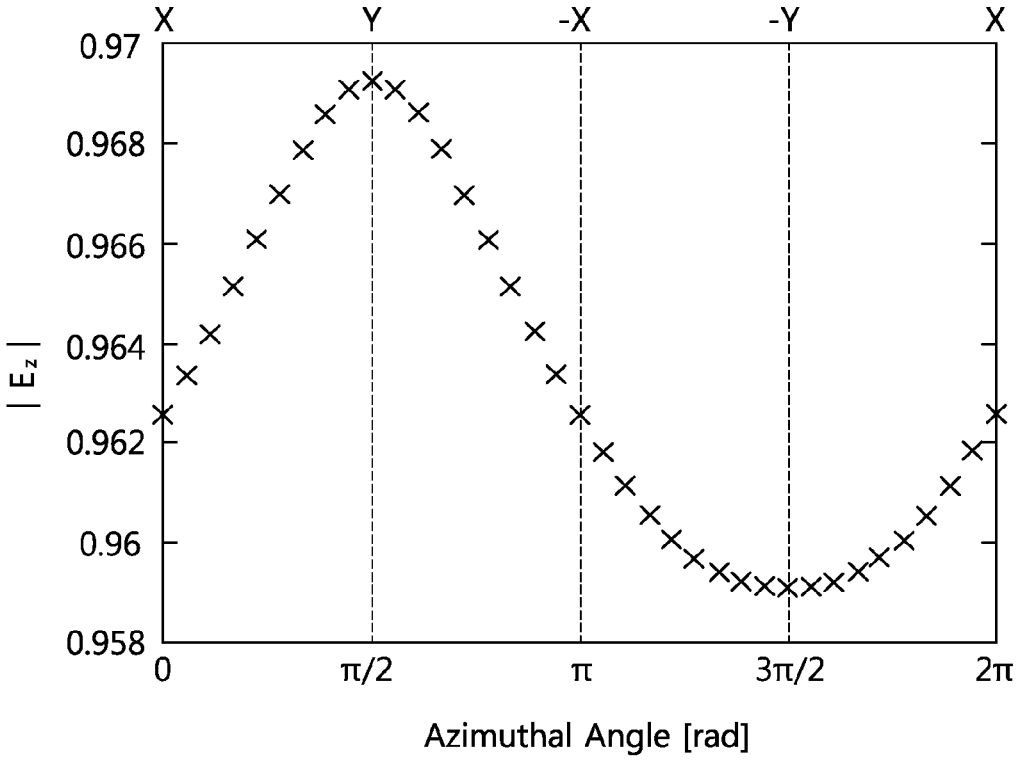
FIG. 4 is a graph showing an electric field of the housing with a single coupling hole.

FIG. 3 is a sectional view schematically showing a housing with a single coupling hole, and FIG. 4 is a graph showing an electric field of the housing with a single coupling hole.

With reference to FIG. 4, Xs represent simulation result values of $|E_z|$, which refers to a dipole field generated by the coupling hole. Those values are obtained by using only the first, the second, and the third terms of the Equation 9. As shown in FIG. 4, it is noted that a relatively strong electric field is generated in the direction in which the coupling hole is formed.

Compared with the monopole field, the dipole field, and the quadrupole field, an influence of a higher order field is as small as can be negligible, so it is critical to eliminate the influence of the dipole field and the quadrupole field in manufacturing a high quality electron beam generation apparatus.

Hereinafter, a method for eliminating the dipole field and the quadrupole field by additionally forming a pumping hole on the housing is described.

Figure 5:
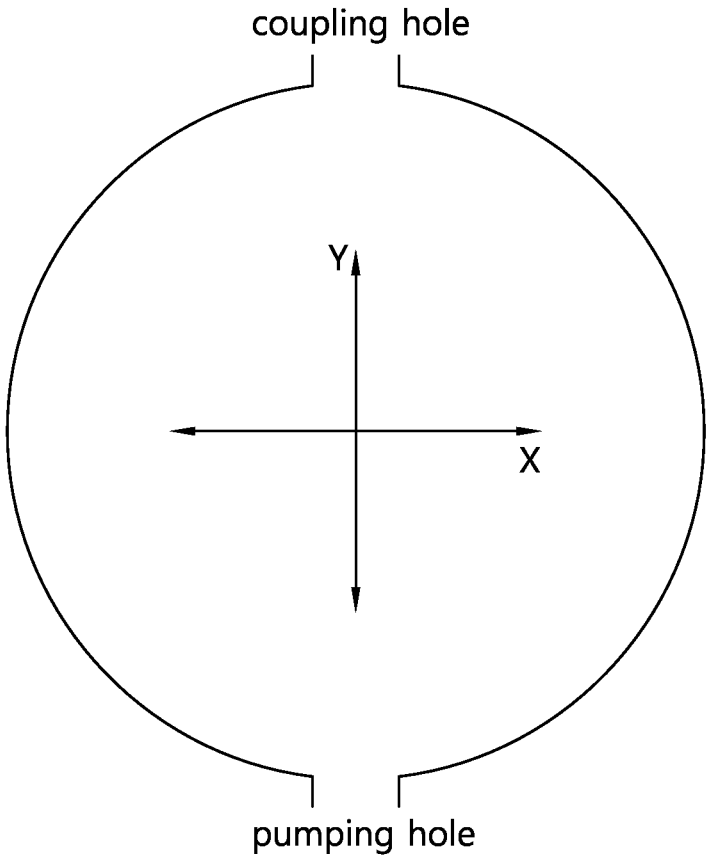
FIG. 5 is a sectional view schematically showing a housing with a coupling hole and a single pumping hole and FIG. 6 is a graph showing electric fields of the housing with a coupling hole and a single pumping hole.
Figure 6:
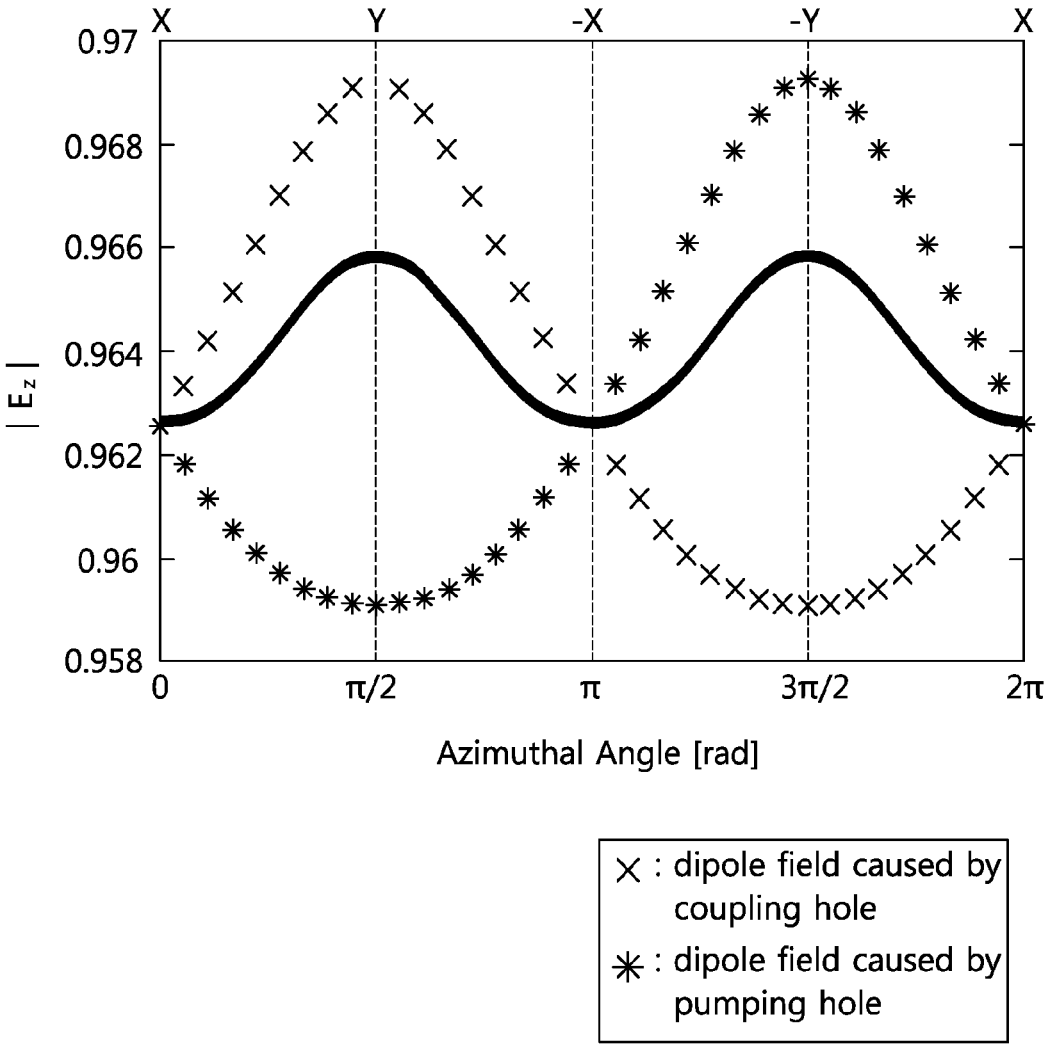

FIG. 5 is a sectional view schematically showing a housing with a coupling hole and a single pumping hole and FIG. 6 is a graph showing electric fields of the housing with a coupling hole and a single pumping hole.

As shown in FIG. 5, a coupling hole, through which electromagnetic waves are supplied, is formed on an upper portion of a housing, and a pumping hole is formed on a lower portion of the housing. The pumping hole serves to cause a dipole field having a phase difference of 180 degrees with respect to a dipole field caused by the coupling hole. Accordingly, the dipole field caused by the coupling hole can be canceled out by using the dipole field caused by the pumping hole.

The shape and size of the pumping hole are generally the same as those of the coupling hole. However, since boundary conditions of the pumping hole and those of the coupling hole are different, the decrement of the dipole field may not be sufficient. Meanwhile, the dipole field may be reduced by simply changing the dimension of the pumping hole. However, this method of reducing the dipole field does not affect the quadrupole field. Eventually, an additional elimination process is required for eliminating the quadrupole field.

In order to eliminate the quadrupole field, the pumping hole is formed to have a racetrack shape. The pumping hole having the racetrack shape can reduce the quadrupole field.

As shown in FIG. 6, the values of the dipole field caused by the coupling hole and those of the dipole field caused by the pumping hole are illustrated. When the dipole field caused by the pumping hole and the dipole field caused by the coupling hole are combined, the dipole field components are canceled out, leaving a quadrupole dominant field having the quadrupole field as a main ingredient. Since the dipole field component is eliminated, it is noted that the emittance is drastically reduced compared with the result value of FIG. 4. Hereinafter, a method for eliminating the quadrupole field by forming two additional pumping holes on the housing is described.

Figure 7:
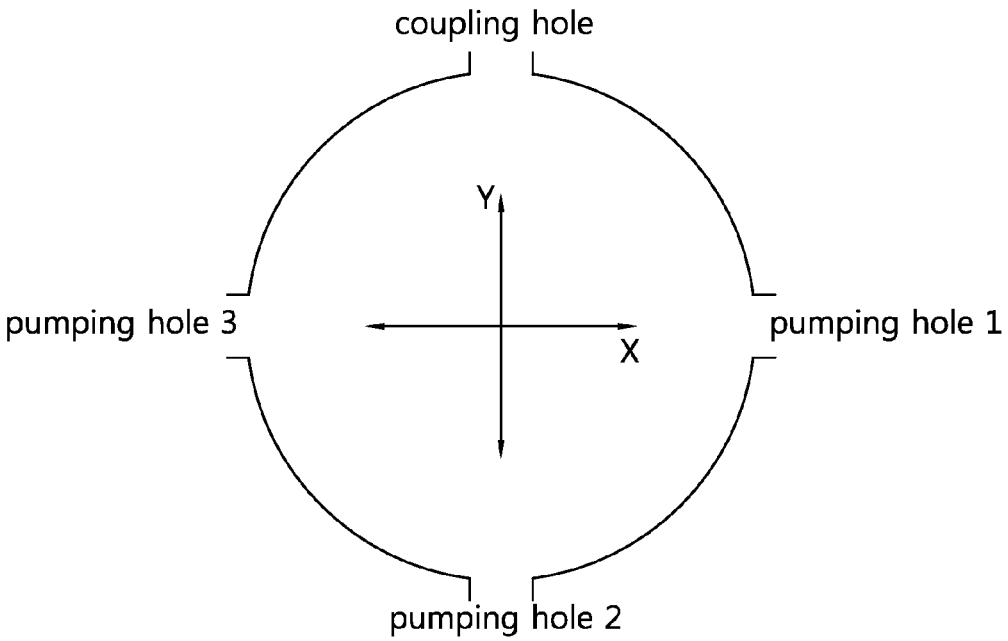
FIG. 7 is a sectional view schematically showing a housing with a coupling hole and three pumping holes.
Figure 8:
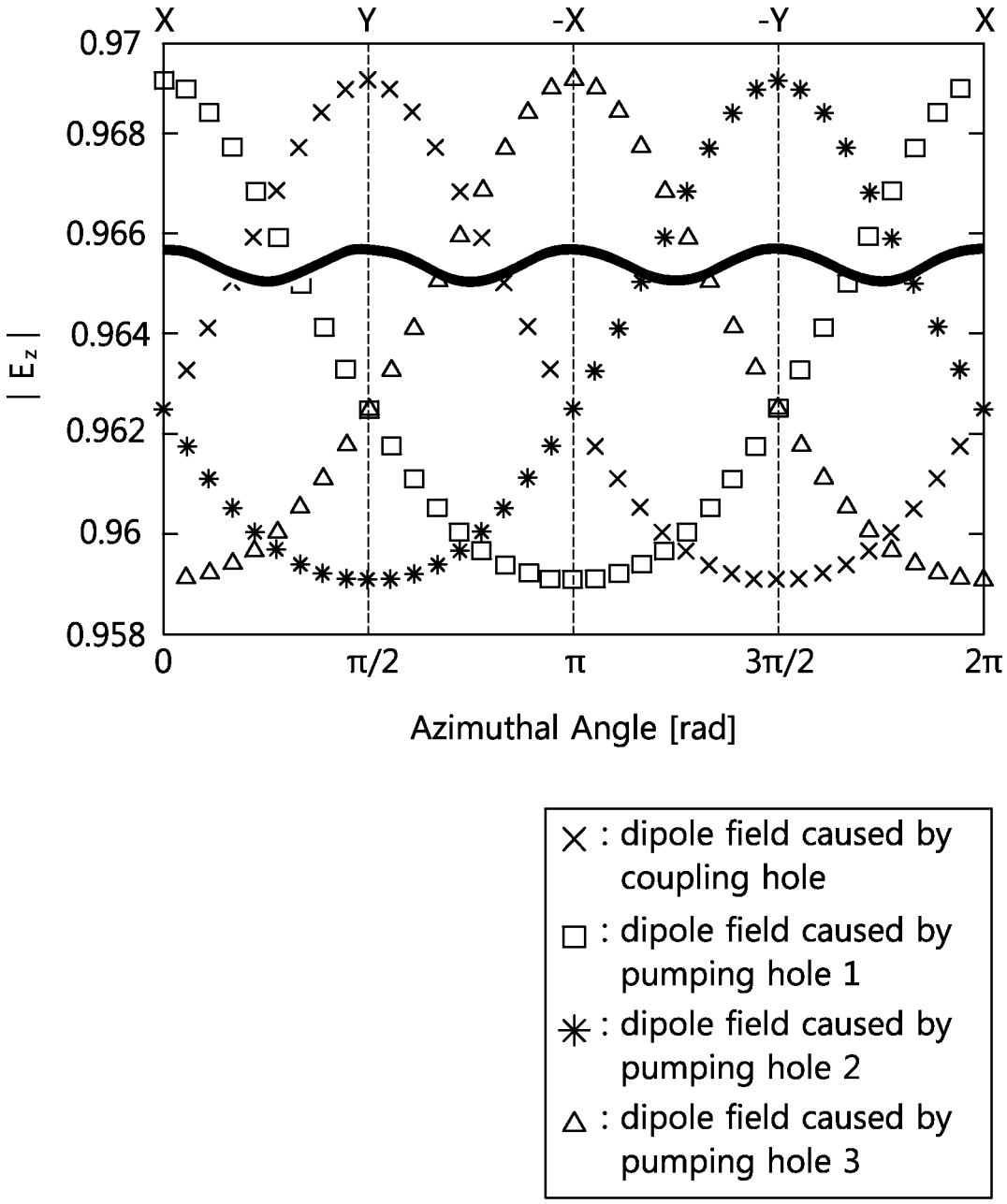
FIG. 8 is a graph showing electric fields of the housing with the coupling hole and the three pumping holes.

FIG. 7 is a sectional view schematically showing a housing with a coupling hole and three pumping holes, and FIG. 8 is a graph showing electric fields of the housing with a coupling hole and three pumping holes.

As shown in FIG. 7, a coupling hole is formed on an upper portion of a housing, and a first pumping hole is formed on a lower portion of the housing, and second and third pumping holes are formed on left and right portions of the housing.

As shown in FIG. 8, the values of the dipole field formed by the coupling hole and those of the dipole fields formed by the first to third pumping holes are indicated. As the dipole fields caused by the first to third pumping holes and the dipole field caused by the coupling hole are combined, the dipole fields and the quadrupole field are canceled out. Thus, only an octopole dominant field having an octopole field as a main ingredient remains. Since the dipole field and the quadrupole field are eliminated, it is noted that the emittance is drastically reduced compared with the result value of FIG. 4.

Figure 9:
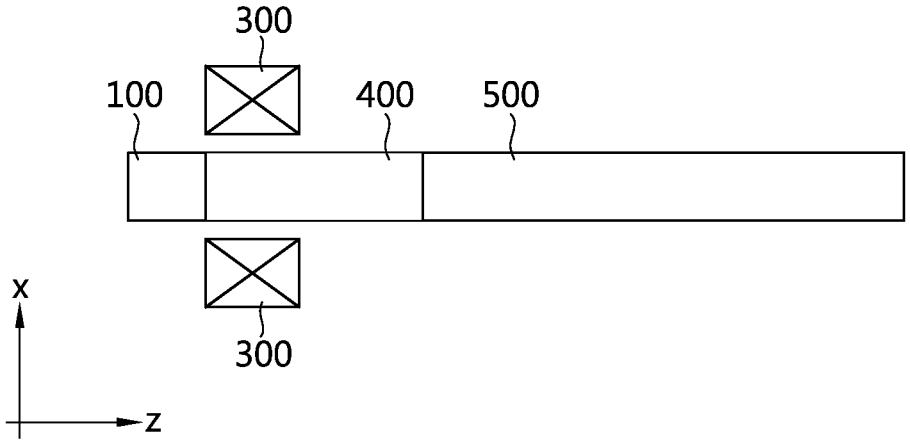
FIG. 9 is a layout view of a simulation device of an electron beam generation apparatus according to an exemplary embodiment of the present invention.

FIG. 9 is a layout view of a simulation device of an electron beam generation apparatus according to an exemplary embodiment of the present invention.

As shown in FIG. 9, an electron beam generation apparatus 100 discharges electron beams, and the discharged electron beams are concentrated by an outer solenoid 300, while passing through a passage 400, and are accelerated, while passing through an accelerating column 500. In order to eliminate an increase in emittance by space charging, the solenoid 300 and a booster linear accelerator are used. An increase of emittance by a multipole field in the resonant cavity can be calculated by mathematical simulation program PARMELA under such simulation conditions.

Figure 10:
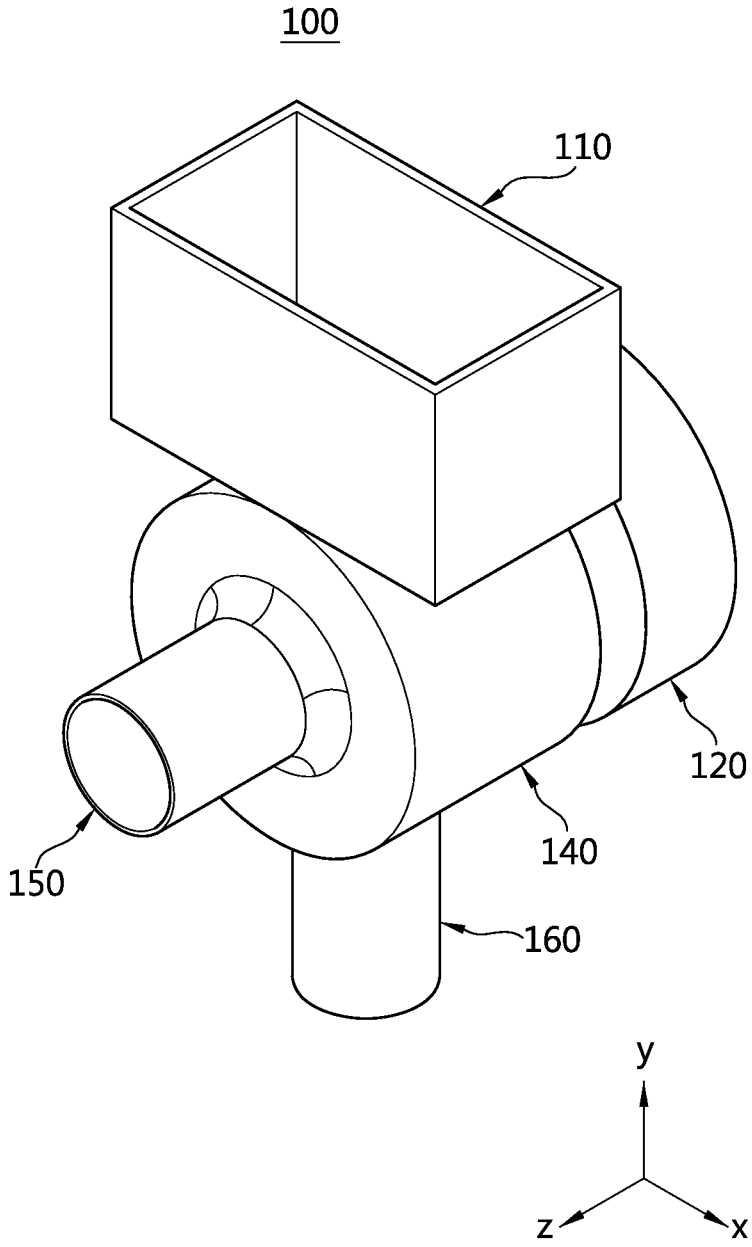
FIG. 10 is a perspective view of an electron beam generation apparatus according to a first exemplary embodiment of the present invention.

FIG. 10 is a perspective view of an electron beam generation apparatus according to a first exemplary embodiment of the present invention.

Figure 11:
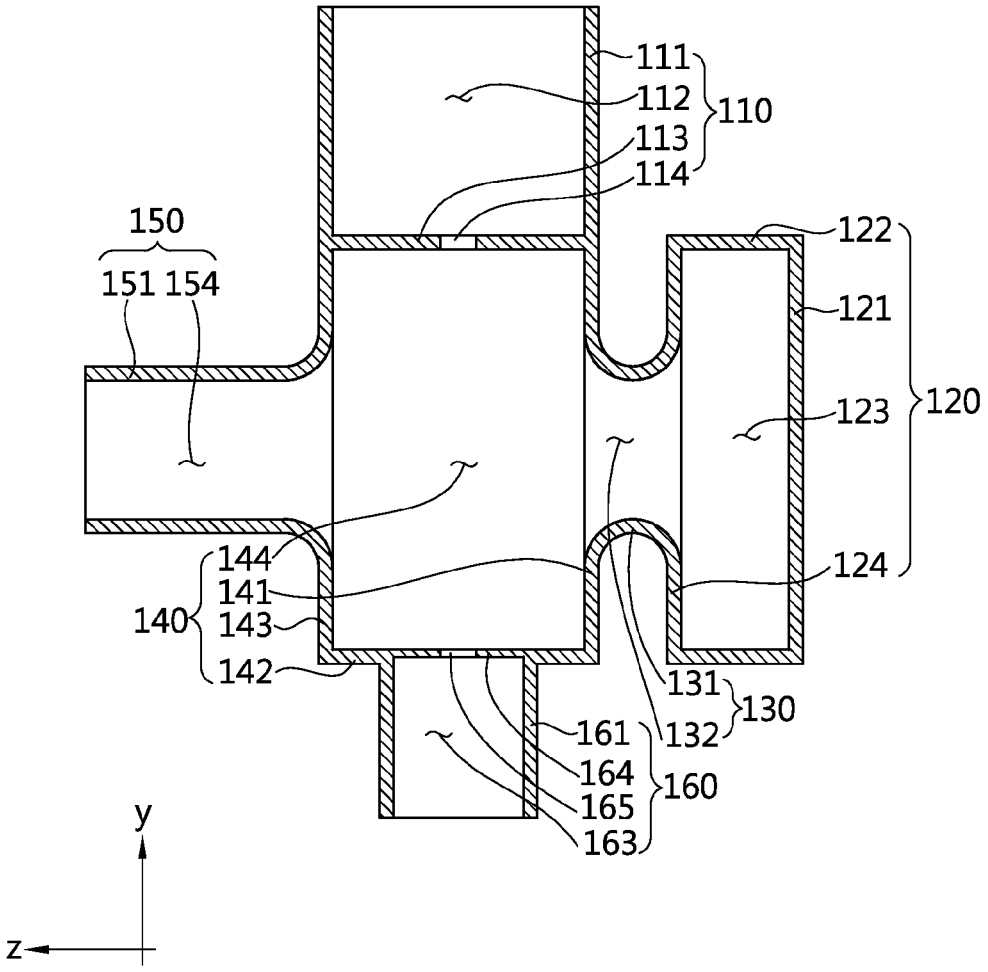
FIG. 11 is a sectional view of the electron beam generation apparatus according to the first exemplary embodiment of the present invention vertically cut to the x axis.

FIG. 11 is a sectional view of the electron beam generation apparatus according to the first exemplary embodiment of the present invention vertically cut to the x axis.

Figure 12:
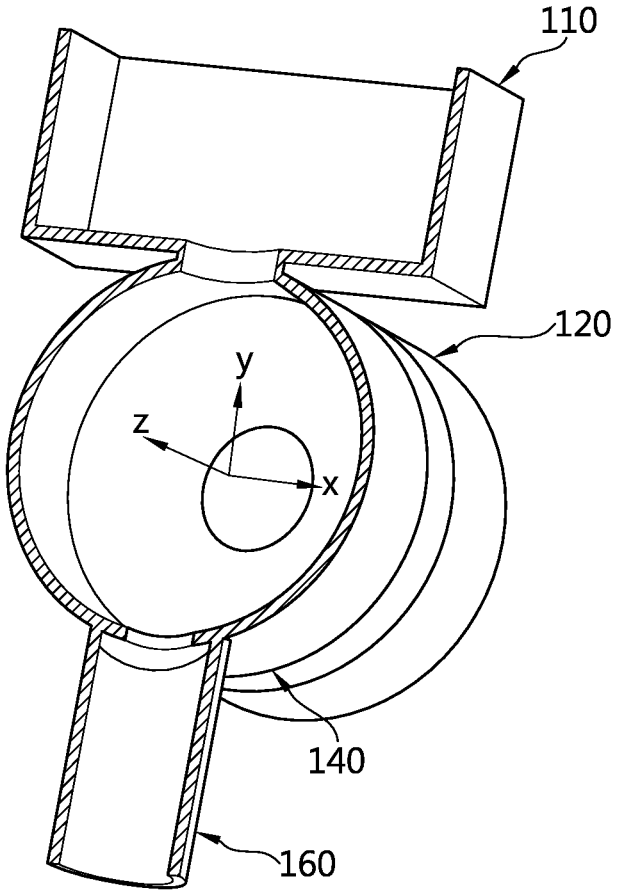
FIG. 12 is a sectional perspective view of the electron beam generation apparatus according to the first exemplary embodiment of the present invention vertically cut to the z axis.

FIG. 12 is a sectional perspective view of the electron beam generation apparatus according to the first exemplary embodiment of the present invention vertically cut to the z axis.

As shown in FIG. 10, an electron beam generation apparatus according to the first exemplary embodiment of the present invention includes a first housing 140, a second housing 120, a waveguide 110, a pumping port 160, and an electron beam discharge pipe 150. In the following description, it is assumed that an electron beam proceeds in a z-axis direction.

As shown in FIG. 11, the second housing 120, having a cylindrical shape, includes an electrode 121, circular plates 124, and a side wall 122. The electrode 121 corresponds to a right side of the second housing 120 based on FIG. 11. The electrode 121 is where an incident laser beam collides to generate an electron beam. The circular plates 124 are spaced apart from the electrode 121 to the left side and face each other. The side wall 122 is provided to connect the electrode 121 and the circular plates 124. A second resonant cavity 123 is formed in the second housing 120. A connection unit 130 includes a curved surface portion 131 and a connection cavity 132. The curved surface portion 131 is provided to have a section having an annular semicircular shape. One side of the curved surface portion 131 is coupled to the circular plate 124, and the other side of the curved surface portion 131 is coupled to a circular plate 141. The connection cavity 132 is a space connecting a first resonant cavity 144 and the second resonant cavity 123.

The first housing 140 includes a circular plate 141(143), and a side wall 142. The circular plate 141 is connected to the curved surface portion 131. The circular plate 143, facing the circular plate 141, is positioned at the left based on FIG. 11, and the side wall 142 connects the circular plate 141 and the circular plate 143. The first resonant cavity 144 is provided in the interior of the first housing 140. The first housing 140 and the second housing 120 may be configured as a single cylindrical housing, rather than being separately configured.

The waveguide 110 includes a side wall 111 and a bottom plate 113. The side wall 111 may have a quadrangular shape, and the bottom plate 113 is connected to a lower surface of the waveguide 110. An electromagnetic wave cavity 112 is provided in the interior of the waveguide 110 in order to transfer electromagnetic waves generated by an electromagnetic wave generation unit (not shown) to the first resonant cavity 144. A coupling hole 114 is provided on the bottom plate 113 to allow the electromagnetic wave cavity 112 and the first resonant cavity 144 to communicate with each other. This is to provide RF power to the resonant cavity. The coupling hole 114 may cause RF asymmetry to the first resonant cavity 144 and also cause asymmetry of an electric field.

The first pumping port 160 includes a side wall 161 and a bottom plate 164. A first pumping cavity 163 is provided at an inner side of the side wall 161. The first pumping cavity 163 is a space for exhaustion to maintain vacuum in the first resonant cavity 144, which can be connected to a vacuum pump (not shown). A first pumping hole 165 is formed on the bottom plate 164 to allow the first resonant cavity 144 and the first pumping cavity 163 to communicate with each other. A dipole field component can be eliminated by adjusting the first pumping hole 165 of the first pumping port 160.

An electron beam discharge pipe 150 includes a side wall 151. One side of the side wall 151 radially extends with a smooth curved surface so as to be coupled to the circular plate 143, and a hole 154 is provided at the other side of the side wall 151 in order to discharge an electron beam. A laser beam is made incident askew to the z axis to the inner side through the hole 154, and an electron beam generated by the laser beam may be discharged through the hole 154. Namely, the hole 154 may serve to perform the functions as an incident hole to which a laser beam is made incident, a discharge hole from which a reflected laser beam is discharged, and an electron beam discharge hole from which an electron beam is discharged.

In a different exemplary embodiment, three holes may be provided, rather than one hole 154. In this case, one hole may be provided as an incident hole to which a laser beam is made incident, another hole may be provided as a discharge hole from which the laser beam is discharged upon being reflected, and the other remaining hole may be provided as an electron beam discharge hole from which an electron beam is discharged, on the side portions of the electron beam discharge pipe 150, the first housing 140 or the second housing 120.

In FIG. 12, an electron beam proceeds in the z-axis direction. A field map used for calculating beam dynamics of emittance is generated by a 3D RF calculator.

Figure 13:
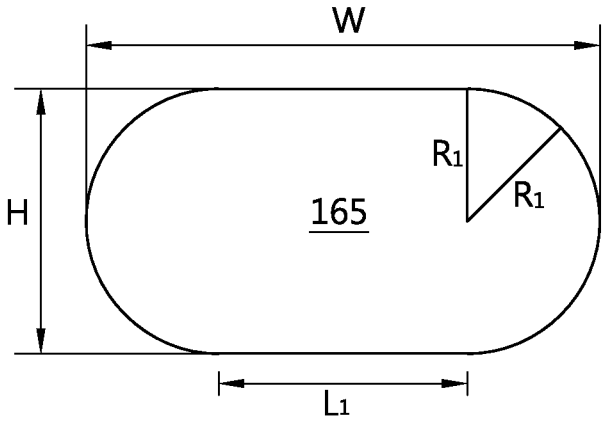
FIG. 13 is a view illustrating the shape of a pumping hole of the electron beam generation apparatus according to the first exemplary embodiment of the present invention.

FIG. 13 is a view illustrating the shape of a pumping hole of the electron beam generation apparatus according to the first exemplary embodiment of the present invention.

As shown in FIG. 13, the difference between a longer-axis length (W) and a shorter-axis direction (H) of the first pumping hole 165 is $L_1$. $R_1$ is a radius of a curved surface portion of both ends of the first pumping hole 165. A multipole field can be eliminated by adjusting $L_1$.

Figure 14:
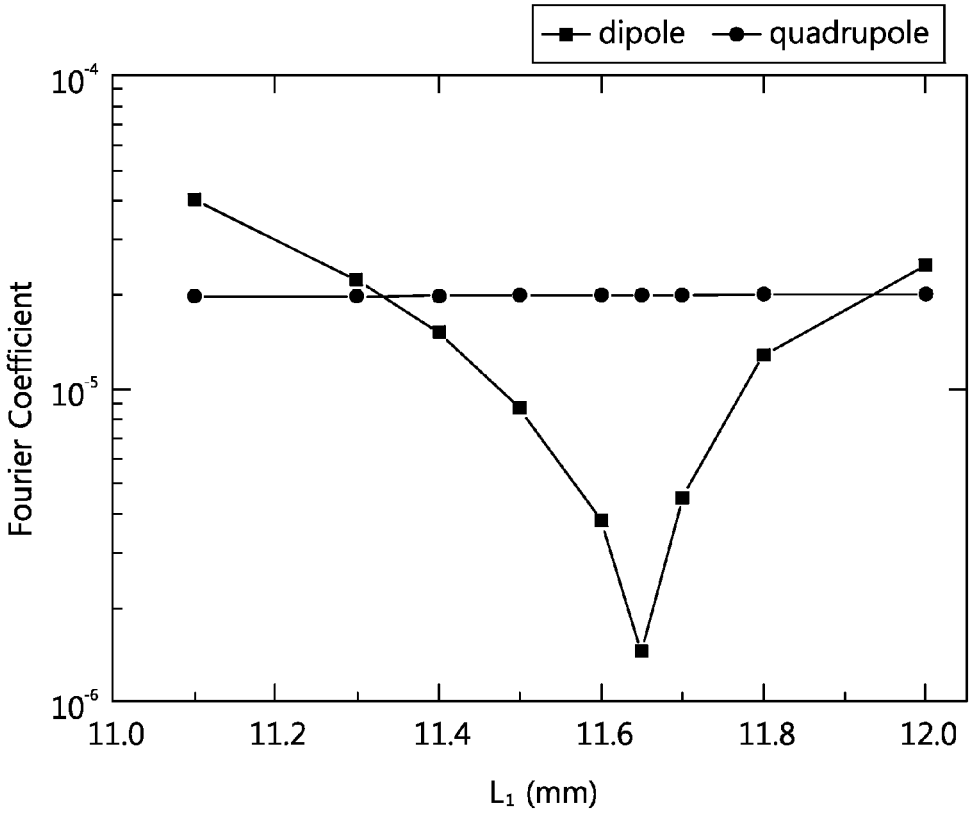
FIG. 14 is a graph showing the relationship between $L_1$ of the electron beam generation apparatus according to the first exemplary embodiment of the present invention and Fourier coefficients.

FIG. 14 is a graph showing the relationship between $L_1$ of the electron beam generation apparatus according to the first exemplary embodiment of the present invention and Fourier coefficients. A dipole field offset oscillation obtained through a mathematical analysis with a calculator is represented in a quadrangular shape in FIG. 14. The connection line in FIG. 14 is obtained by Equation 6. A phase distribution coefficient $K_y$ in the y-axis direction can be calculated according to such an analysis. $K_y$ is a relatively small like $10^{-5}$, so it can be negligible in this experimentation.

An electric field of the pumping hole must be in an evanescent mode, and since the boundary conditions of each of the coupling hole and the pumping hole are different, more optimization processes are required. The dipole mode can be optimized by adjusting the dimension L1 of the pumping hole. The adjustment of the dimension of the coupling hole changes the resonance frequency of the resonant cavity, so the dimension of the resonant cavity needs to be also adjusted. The quadrupole field is not changed, while the dipole field in an optimum dimension is reduced as shown in FIG. 14. As shown in FIG. 14, it is noted that the quadrupole field is greater than the dipole field, after the dipole field is eliminated. The two additional pumping holes provided at the positions of 90 degrees with respect to the pumping hole and the coupling hole can effectively eliminate the quadrupole field. An electron beam generation apparatus according to a second exemplary embodiment is configured to have a simple cylindrical shape and includes two additional pumping holes which can be easily fabricated.

Figure 15:
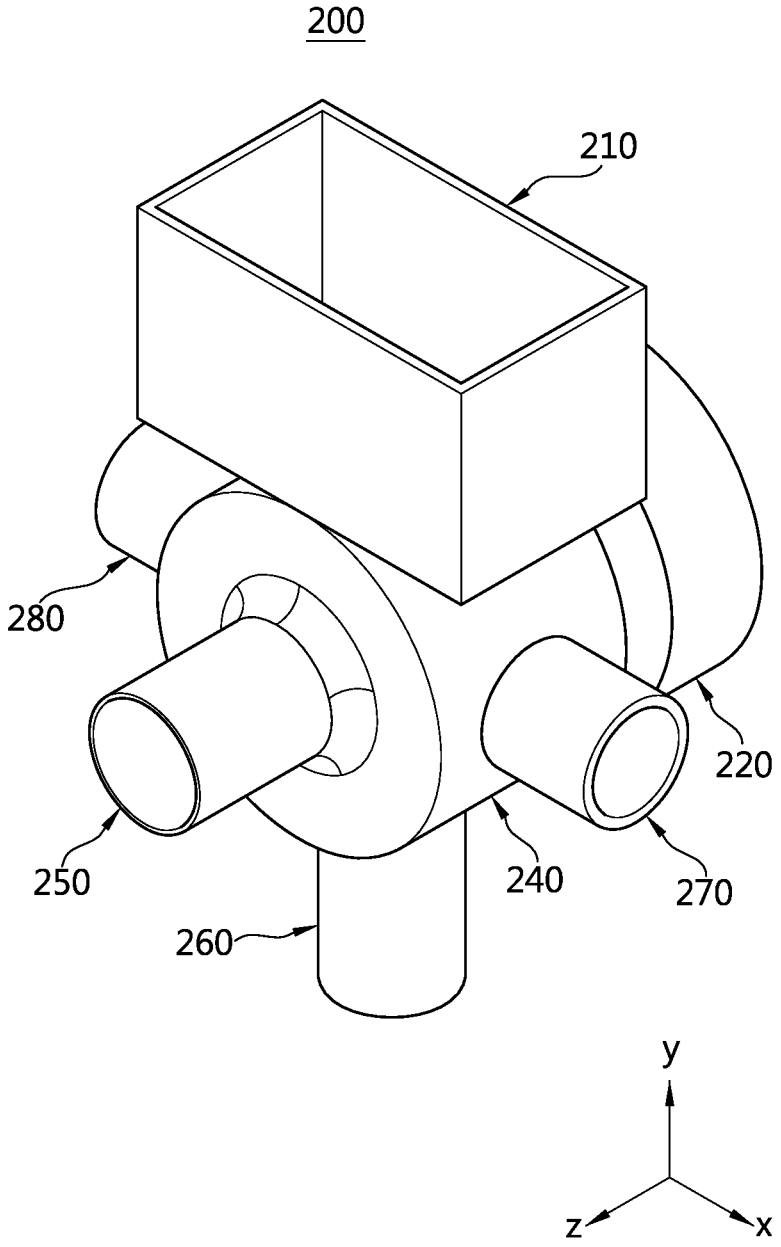
FIG. 15 is a perspective view of an electron beam generation apparatus according to a second exemplary embodiment of the present invention.
Figure 16:
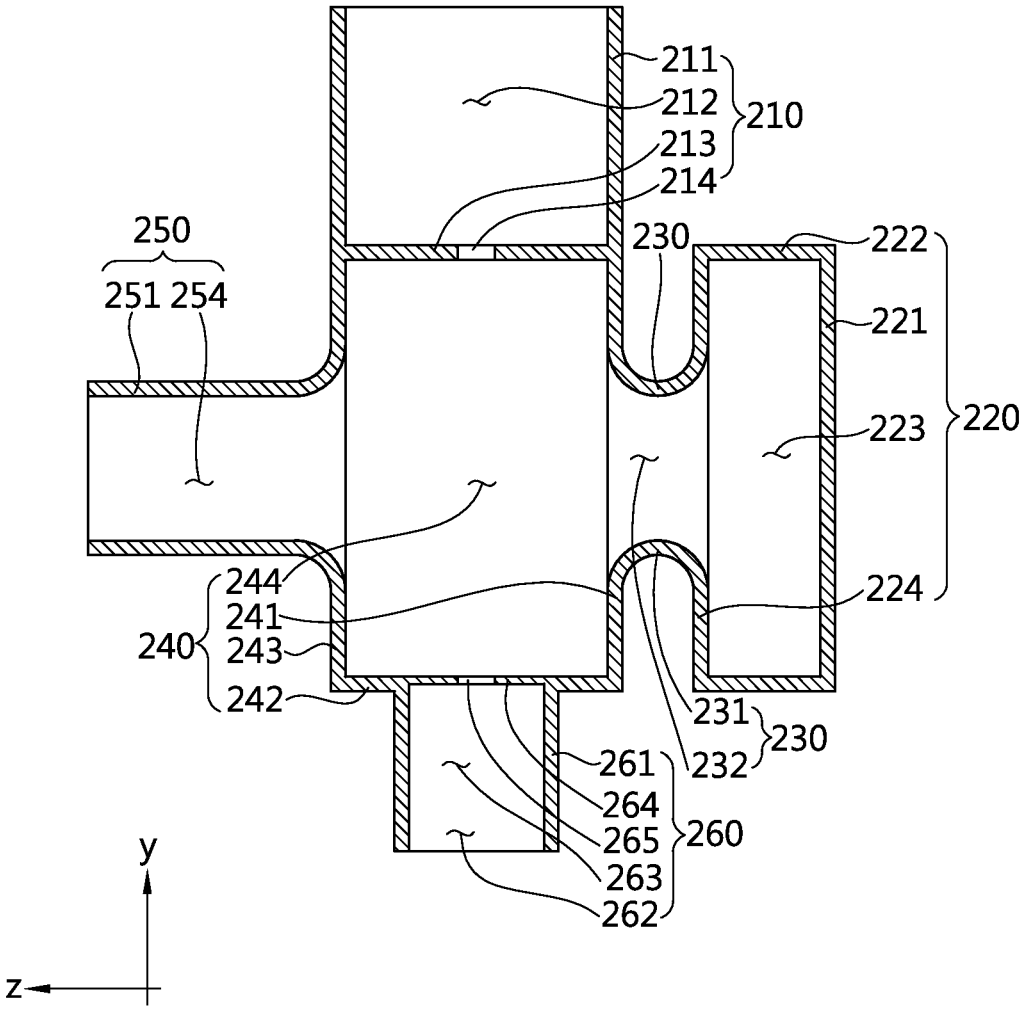
FIG. 16 is a side sectional view of the electron beam generation apparatus according to the second exemplary embodiment of the present invention vertically cut to the x axis.
Figure 17:
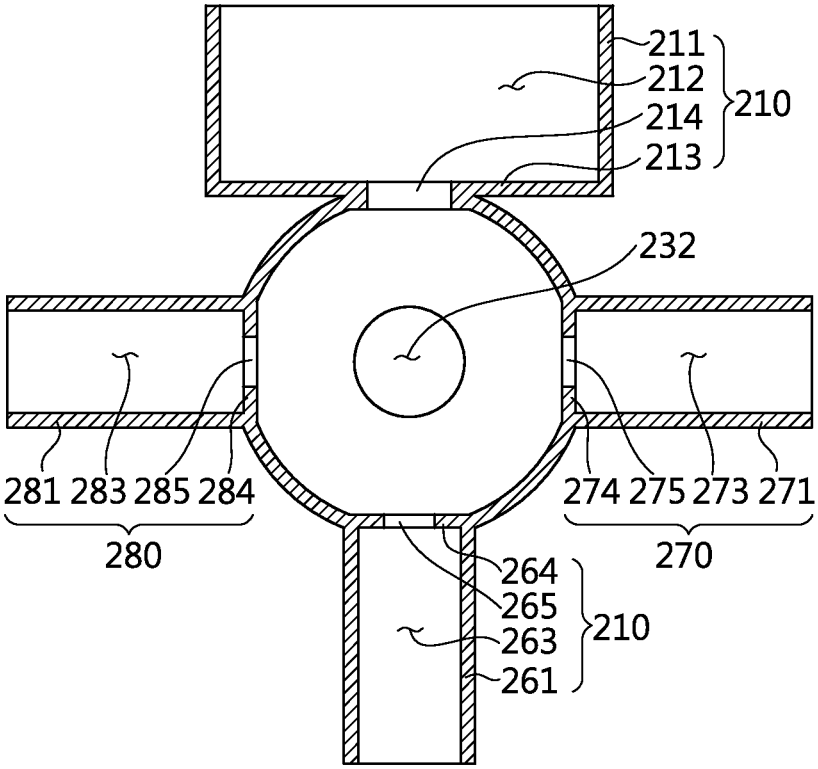
FIG. 17 is a side sectional perspective view of the electron beam generation apparatus according to the second exemplary embodiment of the present invention vertically cut to the z axis.
Figure 18:
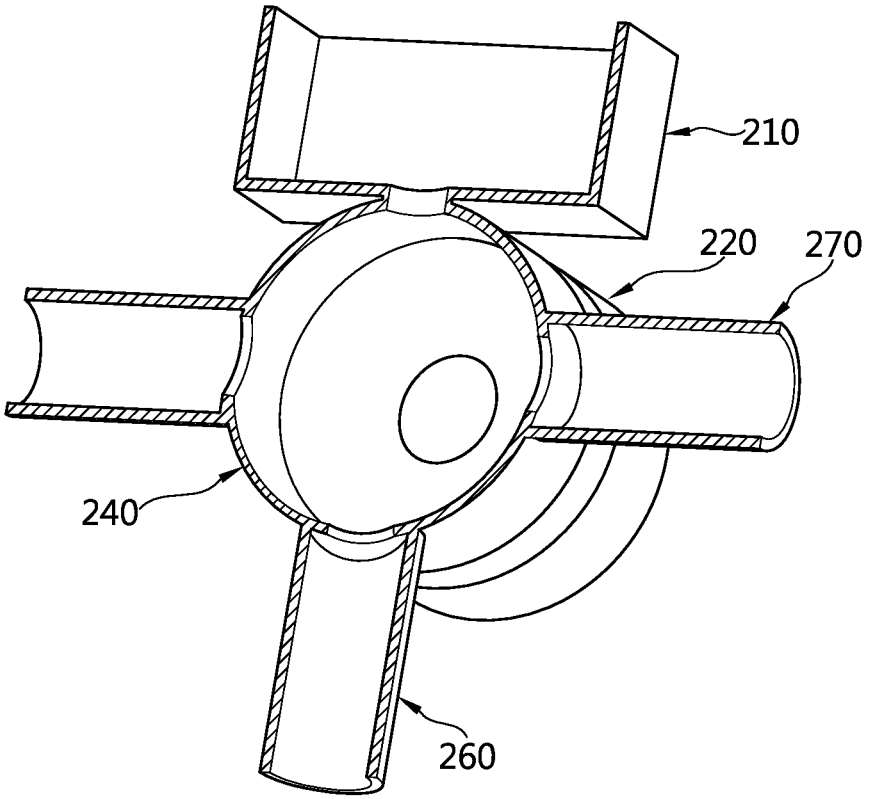
FIG. 18 is a sectional perspective view of the electron beam generation apparatus according to the second exemplary embodiment of the present invention vertically cut to the z axis.

FIG. 15 is a perspective view of an electron beam generation apparatus according to a second exemplary embodiment of the present invention. FIG. 16 is a side sectional view of the electron beam generation apparatus according to the second exemplary embodiment of the present invention vertically cut to the x axis. FIG. 17 is a side sectional perspective view of the electron beam generation apparatus according to the second exemplary embodiment of the present invention vertically cut to the z axis. FIG. 18 is a sectional perspective view of the electron beam generation apparatus according to the second exemplary embodiment of the present invention vertically cut to the z axis. A repeated description of the configuration in FIGS. 16 and 17 similar to that of the first exemplary embodiment is provided below. As shown in FIGS. 15-18, an electron beam generation apparatus 200 according to the second exemplary embodiment of the present invention includes a first housing 240, a second housing 220, a waveguide 210, a first pumping port 260, and an electron beam discharge pipe 250. The second housing 220 includes an electrode 221, circular plates 224, and a side wall 222. The side wall 222 is provided to connect the electrode 221 and the circular plates 224. A second resonant cavity 223 is formed in the second housing 220. A connection unit 230 includes a curved surface portion 231 and a connection cavity 232. One side of the curved surface portion 231 is coupled to the circular plate 224, and the other side of the curved surface portion 231 is coupled to a circular plate 241. The connection cavity 232 is a space connecting a first resonant cavity 244 and the second resonant cavity 223. The first housing 240 includes a circular plate 241 (243), and a side wall 242. The circular plate 241 is connected to the curved surface portion 231. The side wall 242 connects the circular plate 241 and the circular plate 243. The first resonant cavity 244 is provided in the interior of the first housing 240. The waveguide 210 includes a side wall 211 and a bottom plate 213. An electromagnetic wave cavity 212 is provided in the interior of the waveguide 210 in order to transfer electromagnetic waves generated by an electromagnetic wave generation unit (not shown) to the first resonant cavity 244. A coupling hole 214 is provided on the bottom plate 213 to allow the electromagnetic wave cavity 212 and the first resonant cavity 244 to communicate with each other. The first pumping port 260 includes a side wall 261 and a bottom plate 264. A first pumping cavity 263 is provided at an inner side of the side wall 261. A first pumping hole 265 is formed on the bottom plate 264 to allow the first resonant cavity 244 and the first pumping cavity 263 to communicate with each other. An electron beam discharge pipe 250 includes a side wall 251. One side of the side wall 251 radially extends so as to be coupled to the circular plate 243, and a hole 254 is provided at the other side of the side wall 251 in order to discharge an electron beam.

As shown in FIG. 17, a second pumping port 270 includes a side wall 271 and a bottom plate 274. A second pumping cavity 273 is provided in the interior of the second pumping port 270, and a second pumping hole 275 is formed on the bottom plate 274. A third pumping port 280 includes a side wall 281 and a bottom plate 284. A third pumping cavity 283 is provided in the interior of the third pumping port 280, and a third pumping hole 285 is formed on the bottom plate 284. The second pumping cavity 273 and the third pumping cavity 283 are connected with a vacuum pump (not shown) to be used to maintain vacuum in the resonant cavity.

Figure 19:
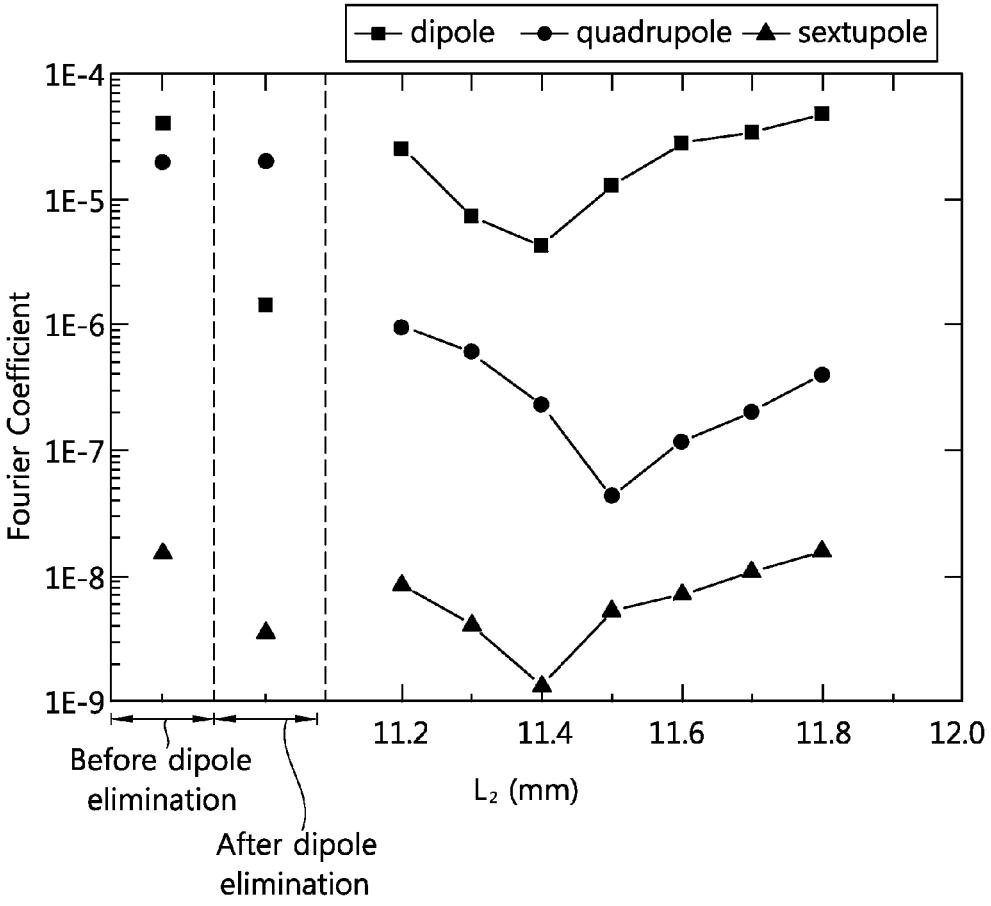
FIG. 19 is a graph showing the relationship between $L_2$ of the electron beam generation apparatus according to the second exemplary embodiment of the present invention and Fourier coefficients.

FIG. 19 is a graph showing the relationship between $L_2$ of the electron beam generation apparatus according to the second exemplary embodiment of the present invention and Fourier coefficients. Here, L2 of each of the first, second, and third pumping holes 165, 275 and 285 is equal, and L1 is fixed to be 11.65. Measurement was performed while changing L2 of each of the three pumping holes in the same manner. In a different exemplary embodiment, optimum conditions may be sought while varying the numerical value L2 of each of the first, second, and third pumping holes 165, 275 and 285.

As shown in FIG. 19, optimum conditions under which both dipole field and quadrupole field are minimized. However, when L2 of the three pumping holes is 11.4 mm to 11.5 mm, the tendency that a higher field is increased can be observed. The dipole field and the quadrupole field are reduced to be about 1/10 times to 1/100 times. Left sides of FIG. 19 show the value of L2 before eliminating the dipole field and the value of L2 after eliminating the dipole field. Accordingly, it is noted that the dipole field can be considerably reduced in the process of eliminating the dipole field, but it does not greatly affect the quadrupole field.

Figure 20:
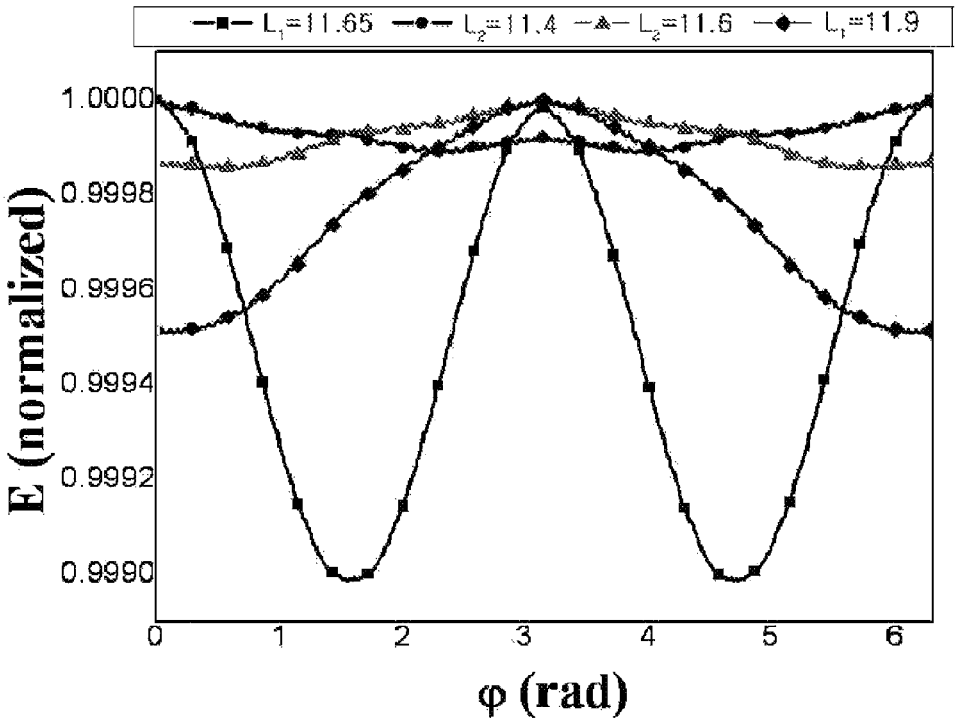
FIG. 20 is a graph showing angle distributions of electric fields according to the first and second exemplary embodiments of the present invention.

FIG. 20 is a graph showing angle distributions of electric fields according to the first and second exemplary embodiments of the present invention.

As shown in FIG. 20, the deviation of the electric fields is considerably eliminated when L2 is in the range of 11.4 to 11.6. With this results, it can be noted that the higher multipole field can be substantially eliminated.

As shown in FIG. 19, the conditions of L2 under which the dipole field and the quadrupole field are minimized are slightly different. In this case, preferably, the condition under which emittance in the beam dynamics simulation is minimum may be considered as quadrupole field optimization conditions. In the present exemplary embodiment, a sextupole mode and an octupole mode are not increased to be meaningful.

Figure 21:
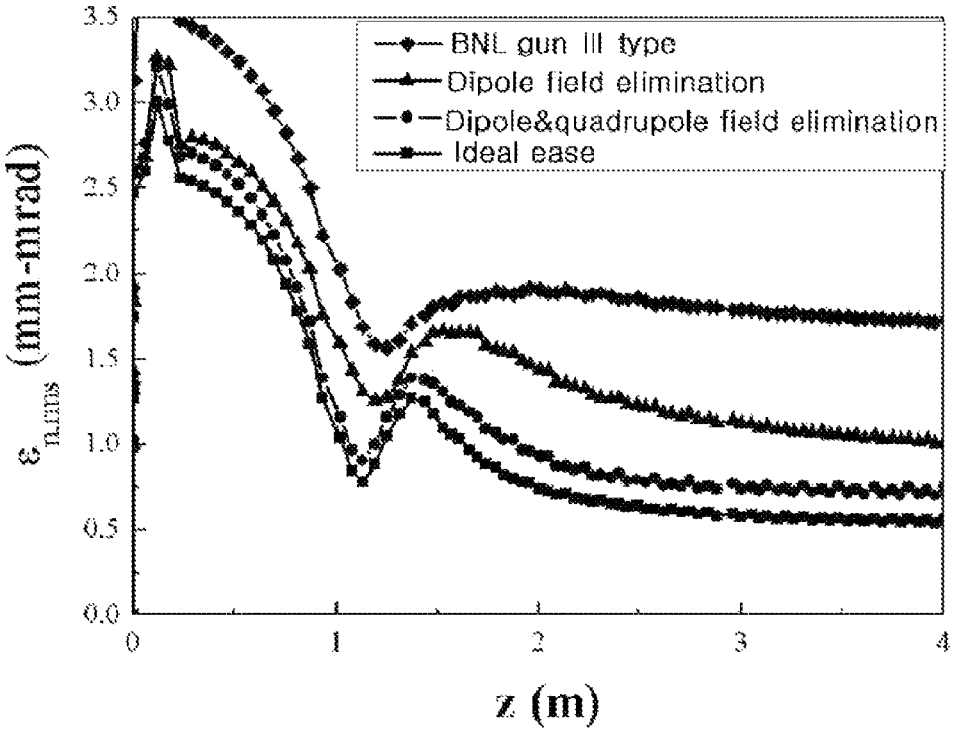
FIG. 21 is a graph showing simulation results of standardization emittance in a y-axis direction to the z axis according to the second exemplary embodiment of the present invention.

FIG. 21 is a graph showing simulation results of standardization emittance in a y-axis direction to the z axis according to the second exemplary embodiment of the present invention.

The quadrangular portions represent an ideal case in which there is no coupling hole and pumping hole. Triangular portions in FIG. 21 represent the results of the dipole field elimination process. Circular portions in FIG. 21 represent a case in which the dipole field and the quadrupole field are eliminated.

The case in which BNL GUN-III is used is represented by diamonds. The BNL GUN-III (BNL/SLAC/UCLA 1.6 cell S-band photocathode RF electron gun) is a model used in Accelerator Laboratory to Pohang University of Science and Technology.

As shown in FIG. 21, in an ideal case, a minimum transverse rms emittance is about 0.53 mm-mrad according to PARMELA simulation, and in this case, a higher multipole field does not appear as represented by quadrangular shapes in FIG. 21. Before adjustment, it is about 1.65 mm-mrad as represented by diamonds in FIG. 21, which is larger than that of the ideal case by three times or more.

The dipole field elimination process can reduce the transverse rms emittance approximately to 0.98 mm-mrad as represented by triangular shapes in FIG. 21. As a result, the emittance can be reduced about 40% through the dipole field elimination process. In case of the dipole field and quadrupole field optimization process, the emittance appears as about 0.60 mm-mrad as represented by circles. In such an optimization conditions, the emittance appears to be reduced by about 60% compared with the case in which the BNL GUN-III is simply used.

An electron beam generation method by using the electron beam generation apparatus according to an exemplary embodiment of the present invention will now be described.

First, a laser beam may be made incident to the interior of the electron beam generation apparatus through the holes 154 and 254.

Next, an electron beam generated in the interior of the electron beam generation apparatus by the laser beam is discharged through the holes 154 and 254.

In a different exemplary embodiment of the present invention, three holes, rather than a single hole, may be provided.

In this case, one hole may be provided as an incident hole to which a laser beam is made incident, another hole may be provided as a discharge hole from which the laser beam is discharged upon being reflected, and the other remaining hole may be provided as an electron beam discharge hole from which an electron beam is discharged, on the side portions of the electron beam discharge pipe, the first housing or the second housing.

In the step of discharging the electron beam, the electron beam may be accelerated by an electromagnetic wave made incident to the waveguide so as to be discharged.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. An apparatus for generating an electron beam, the apparatus comprising:

a housing including a rear portion where an electron beam is generated, a front portion having an electron beam discharge hole for discharging the electron beam to the exterior, and a side portion connecting the rear portion and the front portion, the side portion having a first hole and an opposite side portion, facing the first hole, having a second hole in order to reduce asymmetry of an electric field caused by the first hole; and a waveguide installed on the side portion to supply an electromagnetic wave to the interior of the housing through the first hole, wherein the electron beam is generated by laser incident to the interior of the housing and accelerated by the electromagnetic wave supplied to the interior of the housing;

wherein a third hole is formed between the first and second holes on the side portion of the housing and a fourth hole is formed on an opposite side portion facing the third hole, in order to reduce asymmetry of an electric field caused by the first hole.

2. The apparatus of claim 1, wherein laser is made incident to the interior of the housing through the front portion.

3. The apparatus of claim 1, further comprising:

a first pumping port installed on the side portion and discharging air of the interior of the housing through the second hole to make the interior of the housing vacuumized.

4. The apparatus of claim 1, wherein the second hole has a shape different from that of the first hole.

5. The apparatus of claim 1, wherein the second hole is formed to have a shape elongated in one direction.

6. The apparatus of claim 5, wherein the second hole has a substantially oval shape or a racetrack-like shape.

7. The apparatus of claim 1, wherein the side portion comprises first and second side portions, the front portion is coupled to the first side portion, the first and second side portions are connected by a connection portion, the second side portion is coupled to the rear portion, and the first and second holes are formed on the first side portion or the second side portion.

8. The apparatus of claim 1, wherein the housing comprises an incident hole through which laser is made incident to the interior of the housing, and a discharge hole through which the laser reflected in the interior of the housing is discharged.

9. The apparatus of claim 1, wherein laser is made incident through the electron beam discharge hole, and laser reflected from the rear portion is discharged through the electron beam discharge hole.

10. The apparatus of claim 1, wherein the third and fourth holes have a shape elongated in one direction.

11. The apparatus of claim 10, wherein the third and fourth holes have a substantially oval shape or a racetrack-like shape.

12. The apparatus of claim 1, wherein the second to fourth holes have the same shape.

13. The apparatus of claim 3, wherein a second pumping port is installed at a position where the third hole is formed, and a third pumping port is installed at a position where the fourth hole is formed.

* * * * *